US005167121A

United States Patent [19]

Sepehri et al.

[11] Patent Number: 5,167,121

[45] Date of Patent: Dec. 1, 1992

[54] PROPORTIONAL HYDRAULIC CONTROL

[75] Inventors: Nariman Sepehri; Réal N. Frenette; Peter D. Lawrence, all of Vancouver, Canada

[73] Assignee: University of British Columbia, Vancouver, Canada

[21] Appl. No.: 720,378

[22] Filed: Jun. 25, 1991

[51] Int. Cl.[5] ..... F16D 31/02

[52] U.S. Cl. ..... 60/422; 60/43; 60/459; 91/511

[58] Field of Search ..... 60/420, 422, 428, 430, 60/470, 471, 459; 91/511, 514, 516, 532

[56] References Cited

U.S. PATENT DOCUMENTS

| | | | |
|---|---|---|---|
| 4,712,376 | 12/1987 | Hadank et al. | 60/428 |
| 4,759,183 | 7/1988 | Kreth et al. | 60/422 |
| 4,809,504 | 3/1989 | Izumi et al. | 60/430 |
| 5,048,293 | 9/1991 | Aoyagi | 60/420 |
| 5,050,379 | 9/1991 | Nagai et al. | 60/422 |

OTHER PUBLICATIONS

English translation of Skogsarbeten Bjorn Lofgren Sep. 29, 1986.

*Primary Examiner*—Edward K. Look
*Assistant Examiner*—Hoang Nguyen
*Attorney, Agent, or Firm*—C. A. Rowley

[57] ABSTRACT

A hydraulic control system for a multi-linked manipulator arm monitors the desired flow of hydraulic fluid to each of the actuators for the links of the manipulator, and when the desired flow to any one or more of the actuators exceeds the available flow to the respective actuators, the flows to all the actuators are reduced on the basis of a scaling factor based on the ratio of the available flow to the desired flow of that actuator having the maximum ratio of its desired to available flows so that the relative speed of all the actuators for manipulating the arm is maintained. In some cases some actuators may have higher priority than others and a second scaling factor in which such priorities have been applied may also have to be applied to the flows to reduce the relative speeds of all actuators.

12 Claims, 4 Drawing Sheets

PROPORTIONAL HYDRAULIC CONTROL

Field of the Invention

The present invention relates to a hydraulic control system. More particularly the present invention relates to a hydraulic control system having an improved system for proportioning the flow of hydraulic fluid to the various actuators of the manipulator arm.

BACKGROUND OF THE PRESENT INVENTION

Multi-segmented or multi-linked hydraulically-actuated manipulators such as excavators, until recently, have been controlled by the operator controlling each individual link, (i.e. each actuator for each link) by individually adjusting the flow of hydraulic fluid to an actuator for a selected link or arm segment to obtain a desired movement of the selected link. The operator had to coordinate the necessary motions for each of the links or segments of the arm to obtain the desired movement of the end point of the arm.

To simplify the operator's work resolved or coordinated motion control systems have been incorporated into said multi-linked hydraulic arms. These control systems generally employ a computer using inverse kinematics to determine the necessary angular adjustment of each link to obtain the desired end point movement and to control the hydraulic systems, i.e. the servo valves which in turn control the main hydraulic valves to obtain the flow of fluid required to the actuator for each segment of the arm to obtain the desired end point motion. One such system has been described in EPC Publication No. 0,330,383 published Aug. 30, 1989.

As these systems became more sophisticated it became apparent that further elaborations would be helpful to ensure smoother operation and to ensure the actual arm movements and desired arm movements as requested by the operator do not become too far apart. A system for so controlling the flow to the various actuators to maintain a desired relationship between the actual position and the desired position of the arm segments is disclosed in U.S. patent application Ser. No. 07/556,417 filed Jul. 24, 1990 Frenette et al. In this system the desired movement or position is compared with the actual movement or position of the arm and the signals for valve adjustments are modified in accordance with the difference between the actual position and desired position to ensure that the desired position as seen by the control remains reasonably close to the actual position. This type of system will accommodate slow movement of the boom or the like when the capacity of the equipment is not sufficient to meet the demands placed on it by the manual controller.

As taught in an application by Sepehri et al filed on even date herewith, the load on the actuator being manipulated, i.e. on the particular arm segment being moved by a specific actuator, influences the flow necessary to obtain the desired movement of the arm segment. To compensate for this variation in flow a control system is provided wherein the hydraulic pressure on opposite sides of a piston of an actuator for a given link or arm segment are measured and these pressures are considered in the control algorithm for setting the spool position in the valve controlling flow to or from that particular actuator.

The disclosures of the above applications are incorporated herein by reference.

BRIEF DESCRIPTION OF THE PRESENT INVENTION

It is an object of the present invention to provide a hydraulic control system for a multi-segmented hydraulic arm wherein the rate of movement of the arm is reduced when the demanded rate of movement exceeds the machine capacity i.e. the demanded flow of hydraulic fluid exceeds the available flow.

Broadly the present invention relates to a method of controlling a hydraulic system for a multi-segmented manipulator arm and to a hydraulic system for a multi-segmented or multi-linked manipulator arm that comprises a source of hydraulic fluid and a hydraulic circuit means, means for delivering hydraulic fluid under pressure from said source to said hydraulic circuit means, said hydraulic circuit means including an actuator means for each arm segment of said manipulator arm, a valve means for controlling hydraulic fluid under pressure from said source means to each of said actuator means, control means, said control means including means for determining the desired flow to each of said actuator means to obtain a desired movement of said manipulator based on an input command, means for determining the maximum flow available from said source to each said actuator means, means for comparing the desired flow for each actuator means with said maximum available flow to each respective actuator means to define a scaling factor and means for scaling down flows to all of said actuator means in a selected ratio based on the smallest said scaling factor if said desired flow exceed said flow available from said source for at least one of said actuator means so that the said desired flow for any one of said actuator means does not exceed said maximum available flow to said one actuator means from said source.

Preferably said scaling factor for each actuator means will be based on the ratio of said available flow to said desired flow for each said actuator means having its desired flow exceed its available flow.

Preferably said hydraulic circuit means will include two hydraulic circuits and said source means will comprise a separate pump means for each said hydraulic circuit.

Preferably some of said actuator means will have priority over other of said actuator means and wherein said system will further comprise means for determining if the desired flows to each said actuator means having lower priority exceed the available flow to each said actuator means having lower priority and defining a second scale down factor based on the smallest ratio of available flow to desired flow for said actuator means having lower priority and scaling down said desired flows to all the actuator means based said second scaling factor.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
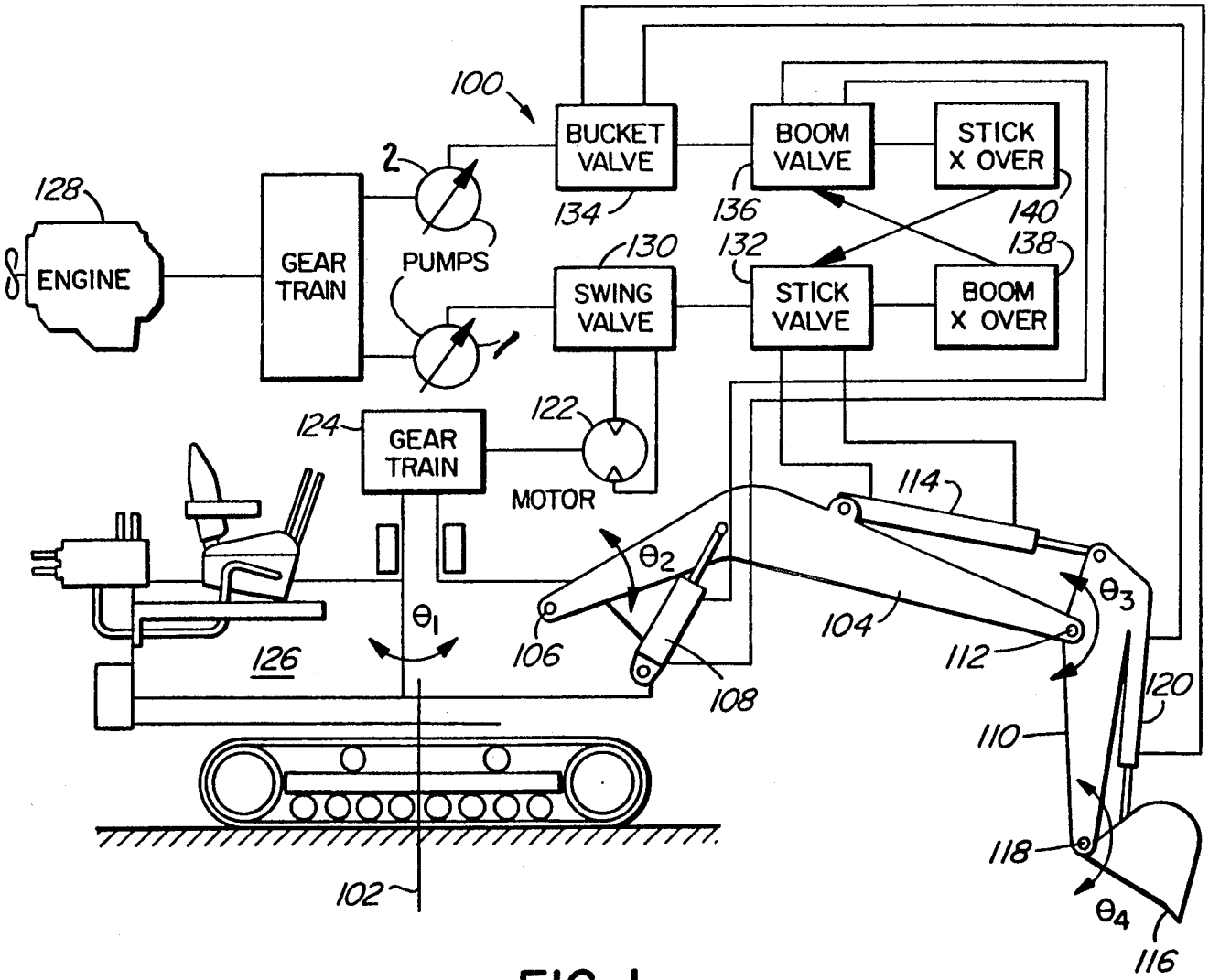
FIG. 1 is a typical hydraulic system for operating an excavator.

In a conventional excavator or the like, i.e. a multi-segmented manipulator arm, a plurality of actuators must be actuated simultaneously to obtain the desired movement of an end point on an arm such as the bucket 116 at the end of the arm formed by the cab 126, boom 104 and stick 110. A typical hydraulic system as shown in FIG. 1 has a swing $\Theta_1$ rotating the body of the unit about the vertical axis or a first axis indicated at 102; a boom 104 pivoted about the axis 106 as indicated by the angle $\Theta_2$ via an double acting actuator 108; and a stick 110 is moveable around pivot point 112 as indicated by the angle $\Theta_3$ by a double acting hydraulic actuator 114. The excavator further includes a bucket 116 moveable about the axis 118 as indicated by the angle $\Theta_4$ by a double acting actuator 120.

The swing angle $\Theta_1$ is adjusted by the hydraulic motor 122 operating through gears 124.

It will be apparent that actuation of the double acting cylinders 108, 114, 120 and the motor 122 driving the gear train 124 to swing the cab 126 are all hydraulically coupled and require power to operate. This power is derived from an engine 128 which through a suitable gear train or the like drives a hydraulic pump. In the illustrated arrangement two separate pumps 1 and 2 are used to service two separate hydraulic circuits that may be selectively interconnected by crossovers.

In this illustration the pump 1 serves the swing valve 130 and stick valve 132 to manipulate respectively the motor 122 for pivoting the cab or body 126 about axis 102 and the double acting hydraulic actuator 114 for moving the stick 110 relative to the boom 104. Pump 2 on the other hand supplies the hydraulic fluid to the bucket valve 134 for operating the double acting cylinder 120 moving the bucket as indicated by $\Theta_4$ and the valve 136 which controls flow to the double acting cylinder 108.

These pumps 1 and 2 change their output flows depending on the load in a well known manner to prevent engine stall and obviously are capable of only delivering a certain maximum flow when the engine 128 is delivering maximum output.

To accommodate different flow regimes, output from pump 1 may be shifted to facilitate movement of the boom 104 as indicated by the cross-over 138 and similarly the output of pump 2 may be shifted to apply fluid to the stick valve 132 as indicated by the stick cross-over 140 depending on the demands of the two hydraulic circuits. The pump 1 services on a priority basis the swing valve 130, then stick valve 132 and then boom cross-over 138 in the first hydraulic circuit.

Pump 2, as above indicated, services on a priority basis first the bucket valve 134, then the boom valve 136 and then the stick cross-over 140 of a second hydraulic circuit.

Figure 2:
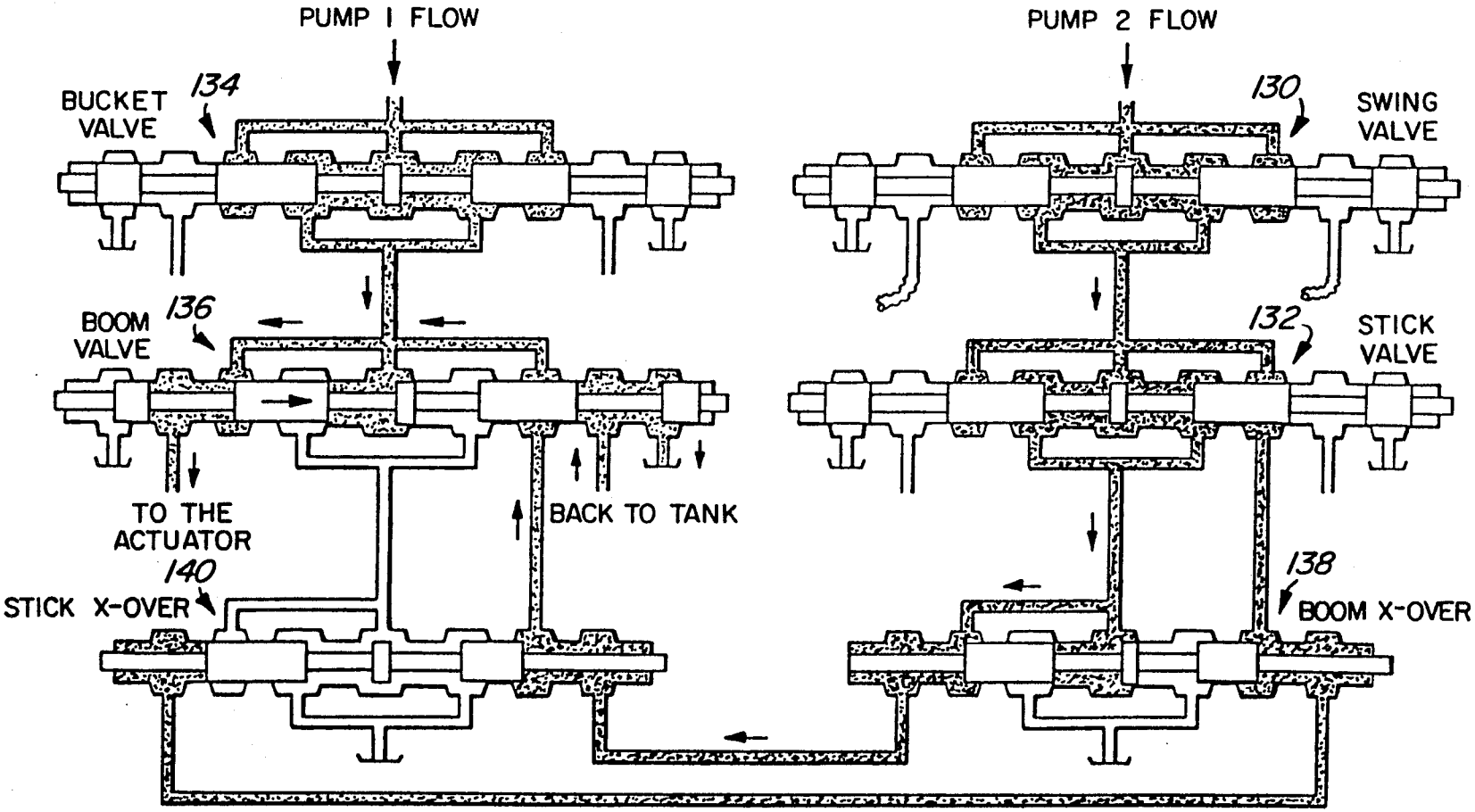
FIG. 2 is a schematic illustration of a typical valve system showing the manner in which the various spool valves are connected.

The particular hydraulic interconnection for the various valves 130, 132, 134, 136, 238 and 140 are shown in FIG. 2.

Figure 3:
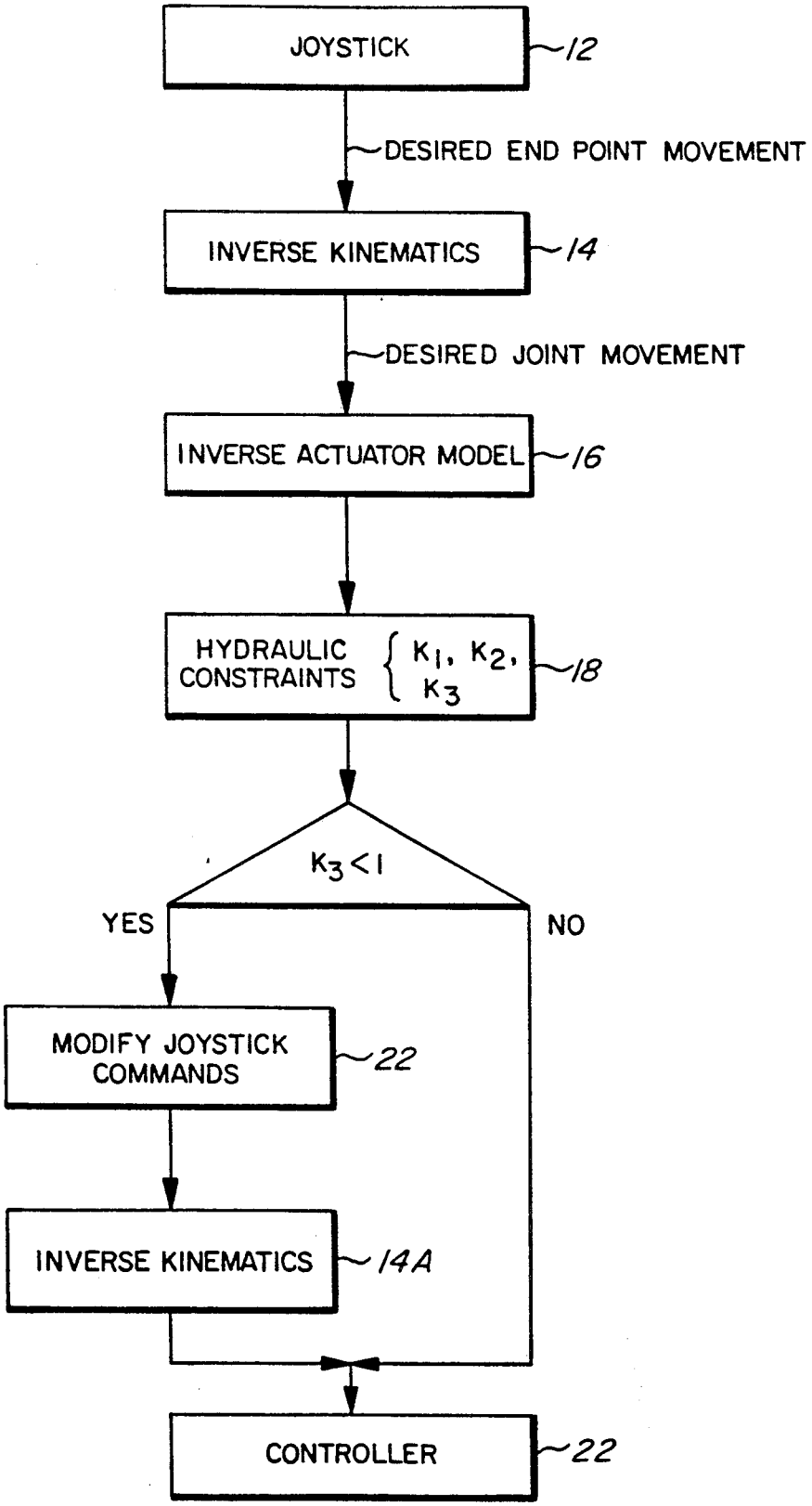
FIG. 3 shows a block diagram of a proportional computer control system incorporating the present invention for hydraulic actuators of a multi-segmented manipulator arm.

A control system for a resolved or coordinated motion system for controlling a multi-segmented manipulator arm is illustrated in FIG. 3. As can be seen, operator commands such as end point velocities are inputted via the joystick or the like 12 to define the desired motion in base or reference co-ordinates, then a computer applies inverse kinematic calculations based on these commands as indicated at 14 to determine the desired joint motion (speed) i.e. joint co-ordinates. The computer then applies an algorithm (inverse actuator kinematics model) to determine the appropriate flow rates to each of the hydraulic actuators as indicated at 16. The flows are then examined to determine the scaling factors $K_1$, $K_2$ and if necessary $K_3$ as will be described hereinbelow as schematically indicated by the box 18 wherein the hydraulic fluid flow constraints of the system are considered.

The scaling factor $K_3$ is determined and if $K_3$ is less than 1 i.e. the answer to the question in 20 is yes, the joystick commands from box 12 are modified by multiplying by $K_3$ to provide modified joystic commands as indicated at 22, the inverse kinematics operation (14 above) is performed as indicated at 14A and the modified signal is used to control the servo valves etc. in the conventional manner as indicated at 24. In some cases it may be desirable to modify joint speed directly instead of the inverse kinematics operation 14A and then the operation 14A may be eliminated and the operation 22 would be "Modify Joint Speeds".

On the other hand if the answer to question 20 is no i.e. $K_3$ is equal to one the signals for the inverse kinematics derived in box 14 are delivered to box 24 without further modification.

The conventional control 24 may incorporate a closed loop control system to ensure that the desired movement does not significantly differ from the actual movement as described in the said application of Frenette et al referred to above. The control 24 may also include a control system based on feed back of hydraulic pressure applied to the actuators as described in detail in the said application of Sepehri et al filed concurrently herewith.

to determine each of the scaling factors $K_1$ and $K_2$ a basic scaling factor K is found for each of the flows is based on the ratio of the flows, namely the ratio of $Q_{(available)}$ to $Q_{(desired)}$ for each case wherein $Q_{(available)}$ exceeds $Q_{(desired)}$ i.e.

$$K = Q_{(available)}/Q_{(desired)}$$

where $K$ = the scaling factor, $Q_{(available)}$ = the available flow from pumps to the selected actuator and $Q_{(desired)}$ = the desired flow to actuators eg. as input determined by the commands.

The scaling factor $K_3$ is determined as follows. First an algorithm to determine the first scaling factor $K_1$ for each link first calculates the desired flow rate of hydraulic fluid to the actuator for each link of the arm (i.e. K for each link) on the basis of the desired joint velocity from the operator's commands, for example, joystick inputs. This flow in the example arm shown in FIG. 1 should act as a first step defining the scaling factor $K_1$ to satisfy the following constraints namely:

$$Q_{BU(Curl/Dump)} \leqq Q_2 \quad (1)$$

-continued $$Q_{SW(Left/Right)} \leqq Q_1 \quad (2)$$

$$Q_{BO(Up)} \leqq Q_1 + Q_2 \quad (3)$$

$$Q_{BO(Down)} \leqq Q_2 \quad (4)$$

$$Q_{ST(In/Out)} \leqq Q_1 + Q_2 \quad (5)$$

where $Q_1$ is the maximum output flow from pump 1 and $Q_2$ is the maximum output from pump 2. $Q_{BU}$, $Q_{SW}$, $Q_{BO}$ and $Q_{ST}$ are the desired flow into the bucket actuator 120, swing motor 122, boom actuator 108 and stick actuator 114 respectively. $Q_1+Q_2$ is the maximum flow provided from both pumps 1 and 2. In the above example the boom cross-over valve is not active during boom-down motion.

Any violation from the above constraints will require modifying the fluid flows before proceeding to the next or second step by proportionally scaling down all the flow-rates, on the basis of a first scaling factor $K_1$. The scaling factor $K_1$ normally based on the ratio of the available flow to the actuator to the desired flow to that actuator (K). K is determined for each actuator and the governing first scaling factor K defining $K_1$ will be the smallest factor K i.e. the scaling factor $K_1$ will be the smallest scaling factor K as determined after examining all the flows. If there is no violation of the constraints i.e. all the so determined Ks are equal or greater than one the scaling factor $K_1$ is set at 1 i.e. there is no modification imposed on the flows.

Where some of the flows take priority over others as in the example excavator shown in FIG. 1 wherein, for example, the Bucket valve 134 takes priority over the Boom valve 136 which in turn takes priority over the Stick cross over 140 (similar priorities occur in the hydraulic circuit for pump 1) a second step is then required and the flow rates modified by scaling factor $K_1$ should (in the example of FIG. 1) satisfy the following constraints as well;

$$Q_2 - Q_{BU(Dump/Curl)} \geqq Q_{BO(Down)} \quad (6)$$

$$Q_1 + Q_2 - Q_{BU(Dump/Curl)} - Q_{SW(Left/right)} \geqq Q_{ST(In-/Out)} + Q_{BO(Up)} \quad (7)$$

A second scaling factor $K_2$ is then calculated as follows;

$$K_{2a} = Q_2 / [Q_{Bu(Dump/Curl)} + Q_{Bo(Down)}] \quad (8)$$

for the constraint indicated by equation (6) or $$K_{2b} = \frac{Q_1 + Q_2}{[Q_{BU(Dump/Curl)} + Q_{SW(Left/Right)} + Q_{ST(In/Out)} + Q_{BO(Up)}]} \quad (9)$$

for the constraint indicated by equation (7). The scaling factor $K_2$ is the smallest of the scaling factors so determined i.e. in the example the smaller of $K_{2a}$ and $K_{2b}$. On the other hand if none of the priority constraints are violated then as above described with respect to $K_1$ the scaling factor $K_2$ becomes unity i.e. $K_2=1$ and no modification is imposed by the second scaling factor $K_2$.

A total scaling factor $K_3$ is then obtained by combining both $K_1$ and $K_2$ and this scaling factor $K_3$ is used to impose the changes on all the command inputs as described above with respect to boxes 22 and 14A and modified signals are used to define the signals that adjust the servo valves controlling the main valves to all the actuators (box 24 above).

$K_3$ is simply the product of $K_1$ and $K_2$ i.e.

$$K_3 = K_1 \times K_2 \quad (10)$$

If $K_3=1$ the outputs of the pumps 1 and 2 can provide the required flows. On the other hand if $K_3$ is less than one (i.e. $K_3<1$) the outputs of the pumps 1 and 2 cannot provide the required flow rates and therefore the input commands require modification to reduce the flow to all the actuators. Since it is important to keep the same direction of movement of the arm as was requested by the input commands from the operator, these input commands are multiplied by the factor $K_3$ (box 22) to provide revised input commands and these commands are used to calculate new desired velocities i.e. are inputted to the step illustrated in box 14A (i.e. the inverse kinematics) and are used for the actual control of the servo valves. As above indicated in some cases the desired joint speeds may be changed rather than the joy stick commands.

Figure 4:
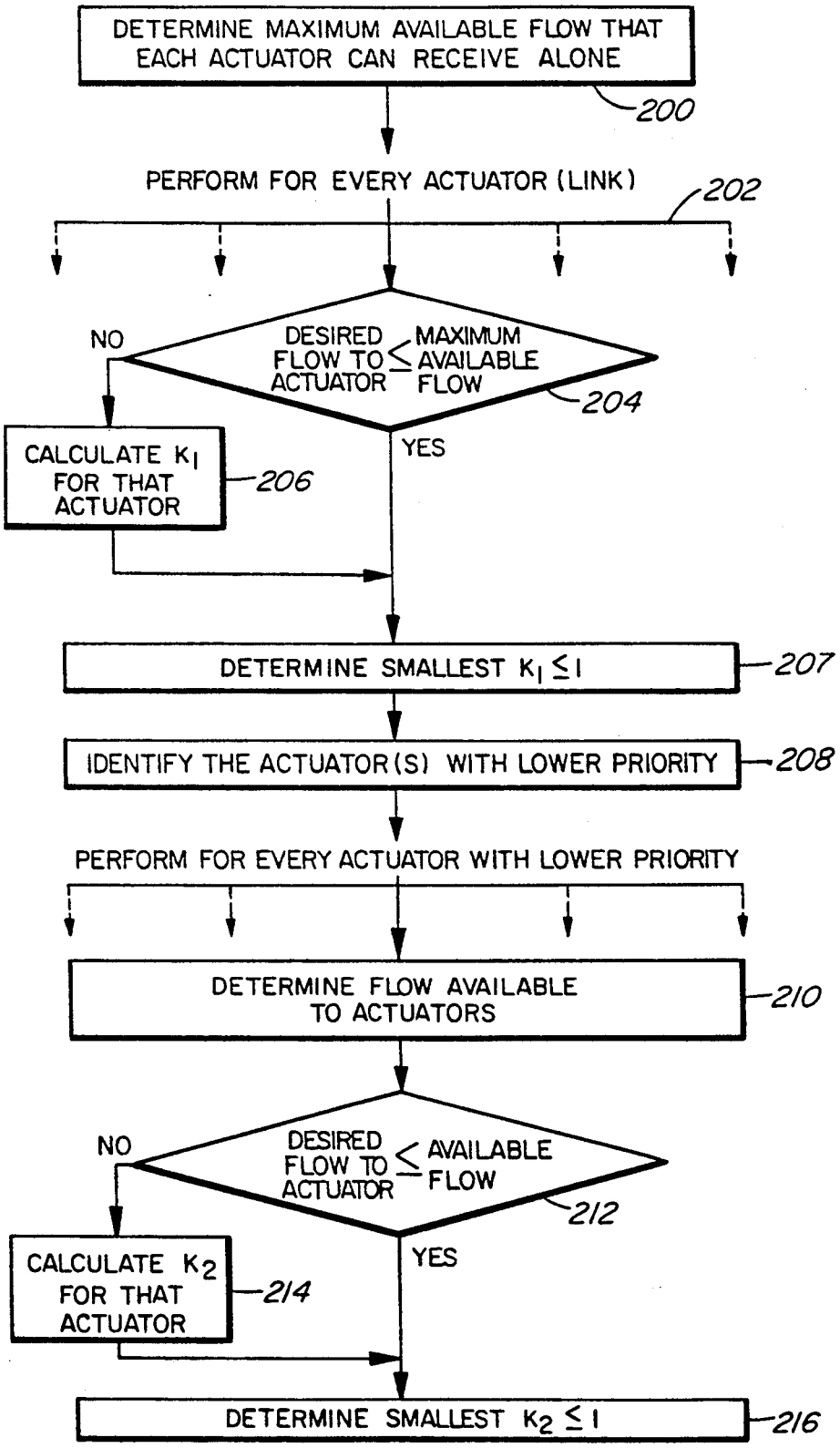
FIG. 4 is a flow diagram showing a for determining scaling factors for use in the proportional hydraulic control system of the present invention.

FIG. 4 shows a flow diagram for a general algorithm for implementing the present invention.

As indicated in FIG. 4 in carrying out the first step as described above with respect to equations 1 to 5 inclusive, the computer first determines the maximum available flow that each actuator can receive as indicated at 200 and determines for each of the actuators, i.e. for the actuator of each link as indicated at 202 a scaling factor K (the desired flow to each actuator is compared with the available flow to that actuator to see if it is equal to or less than the maximum available flow to that actuator). If all the actuators meet this constraint, i.e. the desired flow is equal to or less than the maximum available flow, the scaling factor $K_1$ is set at 1.

On the other hand, each time the desired flow to an actuator exceeds the maximum available flow to that actuator, i.e. the answer is a no to the question in step 204, a scaling factor $K_1$ is computed for that actuator as indicated at 206. The ratio $K_1$ selected or chosen as $K_1$ and used later in the system will always be the smallest ratio for all the actuators as indicated at 207, or as above indicated will be set at 1.

Having determined $K_1$ and satisfied that each actuator operating alone will have sufficient flow, then through having scaled down all the flow rates according to $K_1$, it then becomes necessary to identify any problems that may exist when several actuators are functioning simultaneously. In the particular system illustrated it will be apparent that the swing valve 130 would take priority over the stick valve 132 and similarly the bucket valve 134 takes priority over the boom valve 136 and thus the swing valve 130 and stick valve 132 take priority over the boom cross over 138 and similarly the bucket valve 134, boom valve 136 take priority over the stick cross over 140 and the second step as described above with respect to equations 6, 7, 8 and 9 is carried out to determine $K_2$.

Thus it is important to identify the actuators with the lower priority as indicated at 208 and determine for each of these actuators with lower priority the circuit in which that actuator may receive the flow as indicated at 210.

The next step compares the desired flow to each actuator to the available flow to each actuator based on the determined hydraulic circuit 210. As described above, if any of the desired flows to any of the actuators with lower priority is greater than the available flow to that actuator a scaling factor $K_2$ is calculated for that actuator as indicated at 214. The second scaling factor $K_2$ is then determined at 216 and is equal to the smallest scaling factor $K_2$ determined in station 214 i.e. the lowest ratio of total available flow to total desired flow. If all of the ratios of available flow to desired flow are equal to or greater than one the value of $K_2$ is set at one.

The two scaling factors $K_1$ and $K_2$ found at 206 and 214 are multiplied to provide the scaling factor $K_3$ i.e. $K_3 = K_1 \times K_2$ as above described.

It will be apparent from the above that in general a scaling factor K is obtained whenever the desired flow to a particular actuator exceeds the available flow to that actuator and that the system uses the smallest scaling factor K so that the desired flow to any one of the actuators never exceeds the available flow to that actuator.

The above description has used as an example one particular type of manipulator arm, it will be apparent that with appropriate modifications the invention maybe applied to a variety of different arms including those with sliding joints.

Having described the invention, modifications will be evident to those skilled in the art without departing from the spirit of the invention as defined in the appended claims.

We claim:

1. A hydraulic system for a multi-segmented manipulator arm that comprises a source a hydraulic fluid and a hydraulic circuit means, means for delivering hydraulic fluid under pressure from said source to said hydraulic circuit means, said hydraulic circuit means including an actuator means for each arm segment of said manipulator arm, a valve means for controlling hydraulic fluid under pressure form said source means to each of said actuator means, control means, said control means including means for determining the desired flow to each of said actuator means to obtain a desired movement of said manipulator based on an input command, means for determining the maximum flow available from said source to each said actuator means, means for comparing the desired flow for each actuator means with said maximum available flow to each respective actuator means to define a scale down factor and means for scaling down flows to all of said actuator means in a selected ratio based on the smallest said scale down factor if said desired flow exceed said flow available from said source for at least one of said actuator means so that the said desired flow for any one of said actuator means does not exceed said maximum available flow to said one actuator means from said source.

2. A system as defined in claim 1 wherein said scaling factor for each said actuator means is based on the ratio of said flow available to said desired flow for each said actuator means having its desired flow exceed its available flow.

3. A system as defined in claim 1 wherein said hydraulic circuit means includes two separate hydraulic circuits and said source means comprises a separate pump means for each said separate hydraulic circuits.

4. A system as defined in claim 2 wherein said hydraulic circuit means includes two separate hydraulic circuits and said source means comprises a separate pump means for each said separate hydraulic circuits.

5. A system as defined in claim 1 wherein some of said actuator means have priority over other of said actuator means and wherein said system further comprises means for determining if the desired flows to each said actuator means having lower priority exceed the available flow to each said actuator means having lower priority and defining a second scale down factor based on the smallest ratio of available flow to desired flow for said actuator means having lower priority and scaling down said desired flows to all the actuator means based said second scaling factor.

6. A system as defined in claim 2 wherein some of said actuator means have priority over other of said actuator means and wherein said system further comprises means for determining if the desired flows to each said actuator means having lower priority exceed the available flow to each said actuator means having lower priority and defining a second scale down factor based on the smallest ratio of available flow to desired flow for said actuator means having lower priority and scaling down said desired flows to all the actuator means based said second scaling factor.

7. A system as defined in claim 3 wherein some of said actuator means have priority over other of said actuator means and wherein said system further comprises means for determining if the desired flows to each said actuator means having lower priority exceed the available flow to each said actuator means having lower priority and defining a second scale down factor based on the smallest ratio of available flow to desired flow for said actuator means having lower priority and scaling down said desired flows to all the actuator means based said second scaling factor.

8. A system as defined in claim 4 wherein some of said actuator means have priority over other of said actuator means and wherein said system further comprises means for determining if the desired flows to each said actuator having lower priority exceed the available flow to each said actuator means having lower priority and defining a second scale down factor based on the smallest ratio of available flow to desired flow having lower priority and scaling down said desired flows to all the actuator means based said second scaling factor.

9. A method of operating a hydraulic system for a multi-segmented manipulator arm that comprises a source of hydraulic fluid and a hydraulic circuit means, means for delivering hydraulic fluid under pressure from said source to said hydraulic circuit means, said hydraulic circuit means including an actuator means for each arm segment of said manipulator arm, a valve means for controlling hydraulic fluid under pressure from said source means to each of said actuator means, control means, said method comprising determining the desired flow to each of said actuator means to obtain a desired movement of said manipulator based on an input command, determining the maximum flow available from said source to each said actuator means, comparing the desired flow for each actuator means with said maximum available flow to each respective actuator means to define a scaling factor and scaling down flows to all of said actuator means in a selected ratio based on said scaling factor if said desired flow exceed said flow available from said source for at least one of said actuator means so that the said desired flow for any one of said actuator means does not exceed said maximum available flow to said one actuator means from said source.

10. A method as defined in claim 9 wherein a scaling factor for each said actuator means is based on the ratio of said actual flow to said desired flow for each said actuator means having its desired flow exceed its available flow.

11. A method as defined in claim 9 wherein some of said actuator means have priority over other of said actuator means and wherein said method further comprises determining if the desired flows to each said actuator means having lower priority exceed the available flow to each said actuator means having lower priority and defining a second scale down factor based on the smallest ratio of available flow to desired flow for actuator means having lower priority and scaling down said desired flows to all the actuator means based said second scaling factor.

12. A method as defined in claim 10 wherein some of said actuator means have priority over other of said actuator means and wherein said method further comprises determining if the desired flows to each said actuator means having lower priority exceed the available flow to each said actuator means having lower priority and defining a second scale down factor based on the smallest ratio of available flow to desired flow for actuator means having lower priority and scaling down said desired flows to all the actuator means based said second scaling factor.

* * * * *